United States Patent [19]

Kurz

[11] 4,374,373

[45] Feb. 15, 1983

[54] MULTIPLE CONTACTS, SNAP-ACTION, THERMAL SWITCH

[75] Inventor: Manfred Kurz, Ditzingen, Fed. Rep. of Germany

[73] Assignee: Behr-Thomson Dehnstoffregler GmbH, Kornwestheim, Fed. Rep. of Germany

[21] Appl. No.: 238,984

[22] Filed: Feb. 27, 1981

[30] Foreign Application Priority Data

Feb. 27, 1980 [DE] Fed. Rep. of Germany ..... 3007305

[51] Int. Cl.[3] ..... H01H 37/46

[52] U.S. Cl. ..... 337/383; 200/67 B; 337/390; 337/392; 337/396

[58] Field of Search ..... 337/132, 313, 314, 318, 337/320, 390, 393, 394, 396, 397, 309, 311, 383, 392; 200/67 B

[56] References Cited

U.S. PATENT DOCUMENTS 3,382,339 5/1968 Anderson ..... 200/67 B
4,262,274 4/1981 Howe et al. ..... 337/396

FOREIGN PATENT DOCUMENTS 1285593 12/1968 Fed. Rep. of Germany .... 200/67 B
2444931 4/1976 Fed. Rep. of Germany ..... 337/396

*Primary Examiner*—William H. Beha, Jr.

*Attorney, Agent, or Firm*—Paul M. Craig, Jr.

[57] ABSTRACT

A snap-action thermal switch adapted to be operated by an expansion element. The switch includes a switch reed pivotable between two switching positions, a switch spring exerting force components in a longitudinal direction and in a pivoting direction of the switch reed. One end of the spring engages the switch reed and the other end of the switch spring is articulated to an adjusting element adjustable by an operating piston of the expansion element in such a way that, after attaining a predetermined position of the operating piston, the force component of the switch spring acting in a pivoting direction on the switch reed reverses direction with respect to the switch reed after traversing a zero position. At least one second pivotable switch reed is provided, with the second switch reed being articulated, through its own switch spring exerting a force component in a longitudinal direction and a force component in a pivoting direction of the second switch reed, to the adjusting element. The articulation of the second switch spring to the adjusting element and/or the arrangement of the second switch reed being selected so that a force component of the second switch spring acting in a pivoting direction of the second switch reed reverses direction with respect to the second switch reed in a second predetermined position of the operating piston of the expansion element.

25 Claims, 8 Drawing Figures

Fig. 2
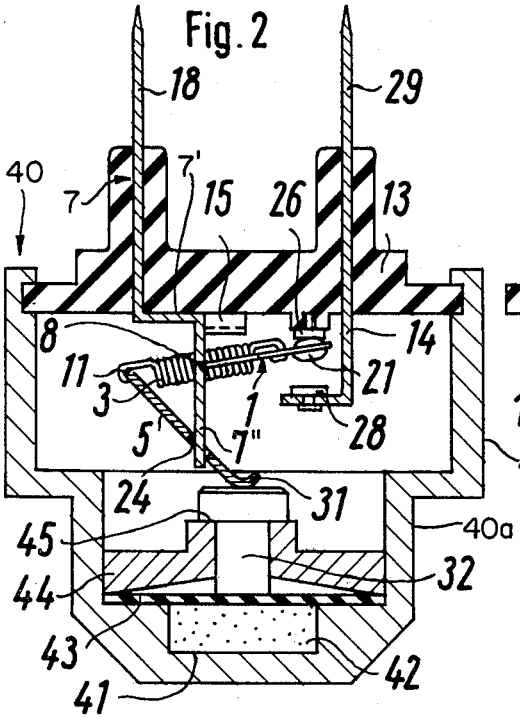
Fig. 3
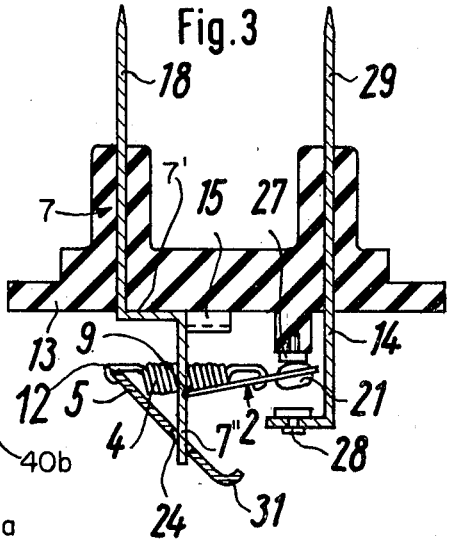
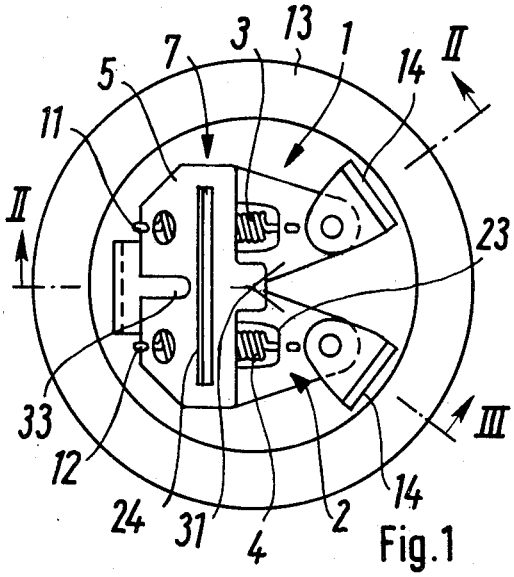
Fig. 1
Fig. 7
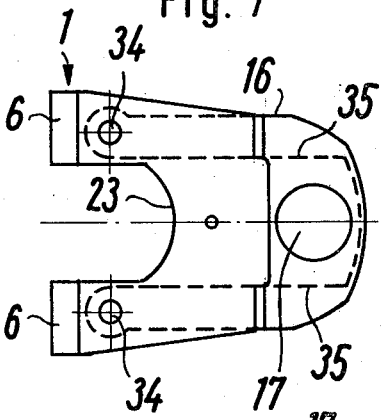
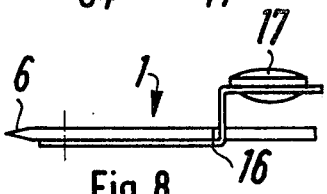
Fig. 8

MULTIPLE CONTACTS, SNAP-ACTION, THERMAL SWITCH

The present invention relates to a switch arrangement and, more particularly, to a thermal switch with a snap action, operated by an expansion element, with the switch including a switch reed or tongue pivotable between two switching positions and engaged by a switch spring which exerts force components in a longitudinal direction and in a pivoting direction of the switch reed, with the other end of the switch spring being articulated to an adjusting element, adjustable by an operating piston of the expansion element, with the articulation being accomplished in such a manner that, after a predetermined position of the operating piston has been reached, a force component of the switch spring acting on the switch reed in a pivoting direction reverses its position with respect to the switch reed after passing through a zero position.

Thermal switches of the aforementioned type have been proposed in, for example, German Auslegeschrift No. 2,444,931 for turning on and off a cooling fan of a vehicle cooling system as required.

In the manufacturing of motor vehicles, it is a desirable goal to reduce engine noises and, for this purpose, a reduction in the engine noises may be accomplished by installing the engine of the motor vehicle in an encapsulated fashion. By encapsulating the engine of the motor vehicle, the possibility of a free air circulation is restricted and, consequently, higher efficiencies are required for cooling fans; however, the increased efficiency is connected with a greater noise emanating from the fan. Thus, it is desirable to adapt the efficiency of the cooling fan to the respective requirements by, for example, a speed control of the cooling fan or by a selective, temperature-dependent insertion of several cooling fans adapted to be cut on and off at various temperatures.

While an infinitely variable control of the cooling fan is a possibility, in most cases such possibility is eliminated by virtue of the expenditures required for providing an infinitely variable control and, under practical conditions, an attempt has been made to make do with two-stage or multiple-stage circuits by, for example, providing two motors for a fan or one motor provided with two windings for a fan, which is adapted to drive the fan at differing speeds and adapted to be turned on at differing engine coolant temperatures. In a similar manner, it is also possible to provide two fans, each of which respectively have separate motors and which are correspondingly switched at varying engine coolant temperatures. For a stepwise increase or reduction of the fan power, it is necessary to trigger electrical switching signals at different temperature stages of the coolant. In order to accomplish the triggering of the electrical switching signals, for example, two or more thermal switches of the aforementioned type may be provided and adjusted to differing temperatures at which they execute a switching step. However, the provision of two or more thermal switches results in an increased expenditure with respect to production and, especially with respect to the necessary mounting and wiring. Moreover, it is difficult with most vehicle engines to mount several thermal switches of the aforementioned type at the internal combustion engine since the installation room required for this purpose is not generally readily available.

The aim underlying the present invention essentially resides in providing a thermal switch of the aforementioned type which is suitable for a multi-stage circuit without increasing the installation work and without requiring additional mounting space.

In accordance with advantageous features of the present invention, at least one second pivotable switch reed is arranged at the snap-action switch. The second pivotable switch reed is articulated, through its own switch spring, to the adjusting element. The switch spring exerts a force component in a longitudinal direction and a force component in a pivoting direction of the switch reed. The articulation of the second switch spring to the adjusting element and/or the arrangement of the second switch reed are selected so that the force component of the second switch spring, acting in a pivoting direction of the second switch reed, reverses its direction with respect to this switch reed in a second, predetermined position of an operating piston of the expansion element.

By virtue of the above-noted features of the present invention, an at least two-stage thermal switch is created which includes only very few additional components such as, for example, the second switch reed and the second switch spring, as well as associated contacts in order to execute a two-stage switching. In all other respects, the same parts are utilized, especially the same expansion element and the same adjusting element transmitting the movement of the expansion element to the switch. Thus, the thermal switch of the present invention requires no more installation space than the space required for a single stage thermal switch. Additionally, the laying out of the electrical wiring for the switch becomes substantially simpler since it is not necessary to connect various points at an internal combustion engine with one another.

In accordance with further advantageous features of the present invention, blades of the two switch reeds preferably rest on a mounting plate from which they project in an approximately mutual parallel relationship. A switch rocker, serving as the adjusting element and pivotable about an axis in parallel to the pivot axis of the switch reeds, is mounted to the mounting plate. The switch rocker is fashioned as a two-armed lever and, with one end, receives the switch springs at articulating points and, with the other end, is associated with an operating piston of the expansion element so that, in an initial position, a perpendicular spacing of the points of articulation for the two switch springs at the switch rocker is selected to be different with respect to an imaginary extension of the associated switch reeds extending beyond the pivot axis. By virtue of these features, a very compact, space-saving construction is realized. Moreover, the perpendicular spacing of the points of articulation to the imaginary extensions of the switch reeds determines, in a simple manner, the instant at which the switch reed snaps over into its other switching position.

In accordance with additional advantageous features of the present invention, the pivot axes of the switch reeds are supported at mutually offset levels with respect to a height of the mounting plate so that it becomes possible to arrange the switch reeds offset to each other whereby a width of the snap-action switch need not be enlarged with respect to a single-stage snap-action switch.

Advantageously, in accordance with the present invention, an arm of the switch rocker receiving the switch spring exhibits two plastically deformable flaps, with each of the flaps having an articulating point for the switch spring. By virtue of the plastic deformation of the flaps, it is possible in a simple manner to set a difference in switching points and also to subsequently correct such difference.

Advantageously, the mounting plate is extended by way of a projection through a base plate of the switch and is fashioned as a contact lug, with the base plate being provided with two contact supports respectively associated with a switch reed and extending toward an outside as contact lugs. The contact supports are arranged preferably on a same radius with respect to a center of the base plate and are mutually offset by a predetermined angle of, for example, 90°.

Advantageously, the two switch reeds may be identically constructed, and the switch reeds may be disposed on a side facing the contacts of the contact supports, with contacts being held by means of springs.

The springs for holding the contacts may take the form of, for example, leaf springs, attached in a proximity of a pivot axis of the switch reeds on a side facing away from the contacts of the contact supports, with a free end of the leaf spring carrying a contact and being extended at a spacing over a side facing the contacts of the contact supports.

Advantageously, in accordance with the present invention, the leaf springs for holding the contacts have a spring stiffness or spring characteristic which is small as compared to the springs of the reed switches, and the mounting plate and/or the base plate are provided with guides which center the switch springs during assembly.

In accordance with still further features of the present invention, a spacing is provided between the mounting plate and contact supports in a longitudinal direction of the switch reeds, which spacing corresponds to at least a length of the switch reeds.

Accordingly, it is an object of the present invention to provide a thermal snap-action switch adapted to be operated by an expansion element which avoids, by simple means, shortcomings and disadvantages encountered in the prior art.

Another object of the present invention resides in providing a thermal snap-action switch adapted to be operated by an expansion element which is adapted for operation in a multi-stage circuit.

A further object of the present invention resides in providing a thermal snap-action switch adapted to be operated by an expansion element which requires no more installation space than a single-stage thermal switch.

Yet another object of the present invention resides in providing a thermal snap-action switch which is adjustable so as to enable a setting of various switching points.

A still further object of the present invention resides in providing a thermal snap-action switch which is simple in construction and relatively inexpensive to manufacture.

Another object of the present invention resides in providing a thermal snap-action switch which functions reliably under all operating conditions.

These and other objects, features, and advantages of the present invention will become more apparent from the following description when taken in connection with the accompanying drawings which show, for the purposes of illustration only, one embodiment in accordance with the present invention, and wherein:

FIG. 1 is a top view of a snap-action switch for a thermal switch arrangement constructed in accordance with the present invention;

FIG. 2 is a cross-sectional view taken along line II—II in FIG. 1 of a snap-action switch with an operating element associated therewith;

FIG. 3 is a cross-sectional view taken along line II—III in FIG. 1;

FIG. 7 is a top view, on an enlarged scale, of a contact reed with a resilient contact for the snap-action switch of the present invention; and FIG. 8 is a lateral view of the switch or contact reed of FIG. 7.

Figure 4:
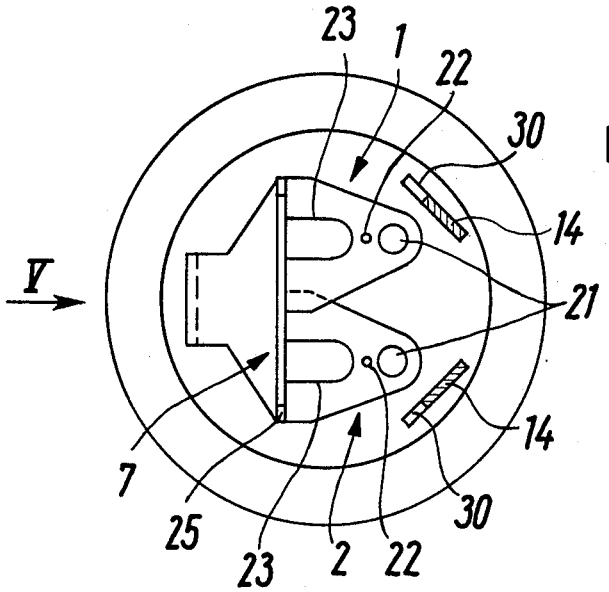
FIG. 4 is a top view of the snap-action switch of FIG. 1 with a switch rocker and switch springs removed.

Referring now to the drawings wherein like reference numerals are used throughout the various views to designate like parts and, more particularly, to FIGS. 1 and 2, according to these figures, a thermal switch includes a tank-shaped housing generally designated by the reference numeral 40 having an expansion element arranged therein and, for this purpose, the tank-shaped housing 40 is formed of two cylindrical sections 40*a*, 40*b* which are staggered in diameter. Section 40*a*, located at a bottom of the switch, has the smaller diameter and is preferably provided with an external thread. The section 40*b*, located above the section 40*a*, preferably has a suitable outer polyhedral configuration or part to enable attachment of a tool thereto.

A recess 41 is provided in an area of a bottom portion of the section 40*a*, with the recess 41 being filled with an expansion material 42 which is preferably, for example, wax. The recess 41 is sealed by a rubber diaphragm 43 which is clamped to the bottom of the section 40*a* by a closure member 44. The closure member 44 includes a central guide for a piston 32 which stands or is supported on the rubber diaphragm 43, with the piston 32 urging the rubber diaphragm 43 into the recess 41 accommodating the expansion material 42. The depth of penetration of the operating piston 32 into the recess 41 is limited by an annular shoulder 45 provided on the operating piston 32. Suitably, the operating piston 32 is provided with an electrical insulation on an end face or end side thereof facing the snap-action switch.

The snap-action switch includes a base plate 13 of a circular shape, with the base plate 13 being adapted to be inserted and flanged into an upper portion of the tank-shaped housing 40. The base plate 13 carries, on a side facing an interior of the tank-shaped housing 40, the snap-action switch, with the switch being provided with contact lugs 18, 29 extending to the outside of the switch.

Figure 5:
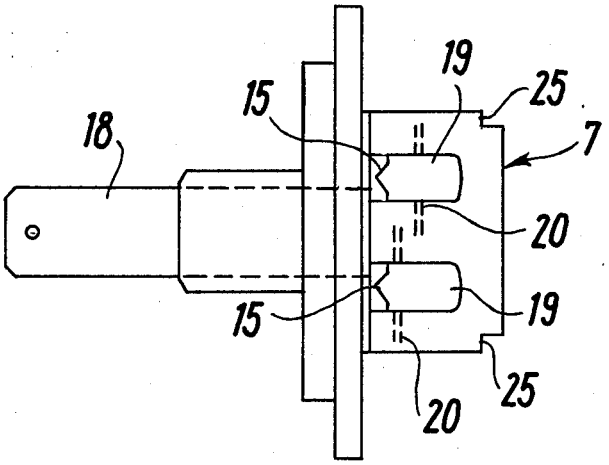
FIG. 5 is a view of the snap-action switch taken in the direction of the arrow V in FIG. 4.

The base plate 13 is preferably an injection-molded part of a synthetic resin material with a mounting plate generally designated by the reference numeral 7 being attached to the base plate 13 in such a manner that the mounting plate 7 projects inwardly into the tank-shaped housing 40. The mounting plate 7 is advantageously a punched and beveled metal part which penetrates or extends through the base plate 13 and forms the contact lug 18 on the outside. The mounting plate 7 includes an angled portion 7' which enables the contact lug 18 to be positioned relatively far toward an outer rim of the base plate 13 while the lower end 7″ of the mounting plate is disposed toward the inside or the center of the base plate 13. As shown most clearly in FIG. 5, the mounting plate 7 is provided with openings 19 and with notches 20 on both sides of the openings 19. Ends of two switch reeds generally designated by the reference numerals 1 and 2, fashioned as blades 6, rest in the notches 20. The notches 20 preferably have a V-shape and a larger opening angle than the blades 6 so that the switch reeds are pivotable about imaginary axes 8, 9 (FIGS. 2, 3). As shown in FIG. 5, the notches 20 are arranged so as to be vertically offset from one another at the mounting plate 7 so that the approximately parallel-extending switch reeds 1, 2 may readily overlap one another in a top view.

As shown most clearly in FIG. 4, the switch reeds 1 and 2 are provided with bores 22 in a zone facing away from the blades 6, that is, in a zone or area of contacts 21 (FIGS. 2 and 3). Switch springs 3, 4, constructed as tension springs, are mounted or attached in the bores 22. The tension springs 3, 4 lie, with their spring windings, in a region of recesses 23 (FIGS. 4 and 7) of the switch reeds 1, 2, which recesses 23 open in a direction toward the blades 6. The switch springs 3, 4 extend through the recesses 19, thereby penetrating the mounting plate 7 and are respectively articulated at their ends to notch-shaped points of articulation 11, 12 of a switch rocker 5. The switch rocker 5 is constructed as a double-armed lever and includes a recess 24 through which the mounting plate 7 perpendicularly projects from the base plate 13.

As shown most clearly in FIG. 5, the mounting plate 7 is provided with lateral shoulders 25 by means of which the position of the switch rocker 5 is fixed. The width of the recesses 24 is dimensioned with respect to a thickness of the mounting plate 7, so that the switch rocker 5 returns, due to the effect of the switch springs 3, 4, into the illustrated rest position shown in FIGS. 1 and 2, wherein the points of articulation 11 and 12 of the spring springs 3, 4 at the switch rocker 5, with respect to an imaginary extension of the switch reeds 1, 2, come to lie on the sides facing away from the contacts 21. This initial position of the switch reeds 1, 2 is determined by stops 26, 27 (FIGS. 2 and 3) which are carried by the base plate 13 and are contacted by rear sides of the contacts 21 on the switch reeds 1, 2.

As shown in FIGS. 2 and 3, contacts 28 are associated with the contacts 21 of the switch reeds 1, 2. The contacts 28 are carried by angled contact supports 14 which penetrate or extend through the base plate 13 and which form contact lugs 29 at the outside of the base plate 13. The contact lugs 29, formed as flat sheet-metal strips, are arranged tangentially to a circle laid through a center of the base plate 13 and are disposed on a common radius. In the switching position (not shown) of both switch reeds 1, 2, an electrical current flows through the contact lug 18, the mounting plate 7, and the switch reeds 1, 2 to the contacts 28 and thus to the contact lugs or reeds 28 and/or in the reverse direction.

As shown most clearly in FIGS. 2, 3, and 5, the base plate 13 is provided on an inside thereof facing the switch with two projections forming notch-like guides 15 extending in parallel to the switch springs 3, 4. The notch-like guides 15, which may also be provided at the mounting plate 7 in the form of embossed zones or the like, serve to facilitate the mounting step. During a mounting, the switch springs 3, 4 are first suspended or hung into the switch reeds 1, 2. Thereafter, the switch reeds 1, 2 are inserted from a side in between the contact supports 14 and the mounting plate 7. In order to make such an insertion of the switch reeds 1, 2 possible and yet provide a large spacing between the contact supports 14, which supports form contact lugs 29 on the outside, the contact supports 14 are provided with cutouts 30 for affording or enabling a lateral introduction of the switch reeds 1,2. After an insertion of the switch reeds 1,7, the switch springs 3, 4 enter the notch-like guides 15 so that a position of the springs 3, 4 is fixed. It is then relatively simple to simultaneously seize, with the articulating points 11, 12 of the switch rocker 5, the ends of the two switch springs 3, 4, whereupon the switch rocker 5 can then be placed with the recess 24 onto the mounting plate 7. The direction of effectiveness of the switch springs 3, 4 in the rest position is such that the switch reeds 1, 2 at the switch rocker 5 are secured against detachment.

The expansion element associated with the thermal switch is arranged so that the operating piston 32 moves vertically with respect to the base plate 13 and, during this vertical movement, the operating piston swings the switch rocker 5, provided with a rounded end 31, about a pivot axis 10 (FIG. 6), which pivot axis is formed by the recess 24 and shoulders 25. The pivot axis 10 extends in parallel to the pivot axes 8, 9 of the switch reeds 1, 2 and all pivot axes 8, 9, 10 extend at right angles to a direction of movement of the operating piston 32.

Figure 6:
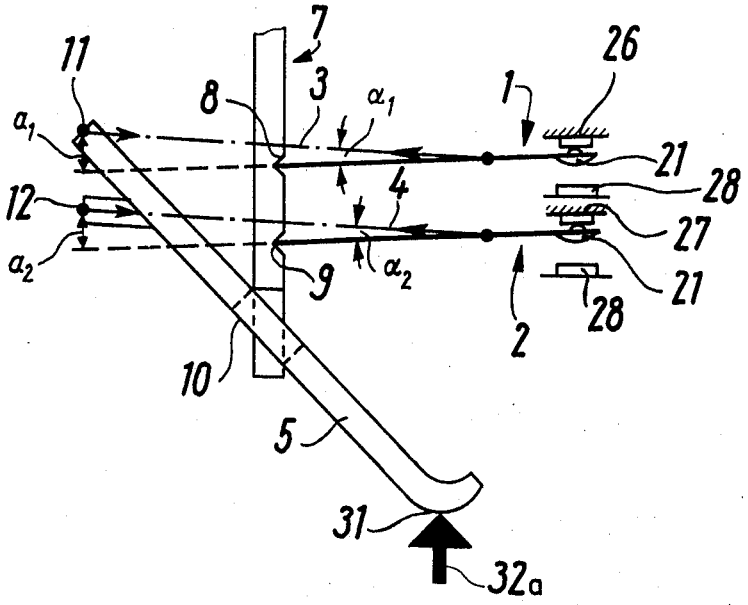
FIG. 6 is a partially schematic view, on an enlarged scale, of movable parts of the snap-action switch of FIG. 1.

The snap-action switch functions in the following manner:

In the schematic illustration of FIG. 6, the switch reeds 1, 2 are illustrated as straight lines and the switch springs 3, 4, in phantom lines. If the operating piston schematically represented by the arrow 32*a*, rotates the switch rocker 5 about its pivot axis 10, the points of articulation 11, 12 of the switch springs 3, 4 are displaced whereby the direction of effectiveness of the switch springs 3, 4 is altered. The switch springs 3, 4 extend, in a rest condition, under a predetermined angle $\alpha$ obliquely to a longitudinal direction of the switch reeds 1, 2 so that the switch springs 3, 4, in addition to having a force component in a longitudinal direction of the switch reeds 1, 2, also have a force component at right angles thereto, that is, in a direction of pivotability about the axes 8, 9. In this rest position, the force component in the pivoting direction is utilized for maintaining the switch reeds 1, 2 at the stops 26, 27. By a pivoting of the switch rocker 5, the direction of effectiveness of the switch springs 3, 4 is changed in such a manner that the angles $\alpha$ become increasingly smaller, that is, the direction of effectiveness for the switch springs 3, 4 is displaced into a longitudinal direction of the switch reeds 1, 2.

If a direction of effectiveness of the switch springs 3, 4 extends in a longitudinal direction of the switch reeds 1, 2, that is, if the point of articulation 11, the axis 8, and the point of articulation of the switch spring 3 to the switch reed 1, are on a straight line. Correspondingly, the point of articulation 11, the axis 9, and point of articulation of the switch spring 4 to the switch reed 2 also lies along a straight line. Consequently, a zero position is reached wherein no force is effective in the pivoting direction of the switch reed 1 or 2. Once this zero position is passed, a force component is immediately produced in a pivoting direction of the switch reed 1, 2 which is a cause for the sudden snap-over of the switch reeds 1, 2 and the contacts 21 come in contact with the contacts 28. If the switch rocker 5 moves back, the reverse procedure takes place wherein the contacts 21 are suddenly detached from the contacts 28 and snap over into their position whereby they contact or touch stops 26, 27. Since also in this direction there is no jump-like change in the spring forces of the switch springs 3, 4 and therefore there is also an extensively constant load on the rounded portion 31 of the switch rocker 5, the switch springs 3, 4 may be constructed or designed so that they produce the restoring force for the expansion element. Consequently, it is not necessary to provide a separate restoring spring for the expansion element.

The distance which must be traversed by the operating piston 32 of the expansion element for triggering the snap-over of the switch reeds 1, 2 from the rest position, and the corresponding turning of the switch rocker 5 depend on the angle $\alpha$ formed between the effective direction of the switch springs 3, 4 and the switch reeds 1, 2 in the rest position. The larger the angle $\alpha$, the longer the distance to be traversed until the snap-over action occurs. By virtue of this fact, it is possible to adjust the snap-action switch so that the switch reeds 1, 2 snap over at differing positions of the operating piston 32 of the expansion element and thus also at differing positions of the switch rocker 5.

As shown most clearly in FIG. 6, the angles $\alpha_1$ and $\alpha_2$ between the effective direction of the switch springs 3, 4 and associated switch reeds 1, 2 in the rest position are determined by the position of the stops 26, 27, the position of the pivot axes 8, 9 and the position of the points of articulation 11, 12. Under practical conditions, it is advantageous, insofar as possible, to arrange the two switch reeds in a juxtaposed relationship so that the pivot axes 8, 9 can be arranged coaxially to each other.

For reasons of a unitary and simple construction, it is also advantageous to arrange the stops 26, 27 as well as the contacts 28 at mutually corresponding locations and at equal spacings since this will facilitate manufacturing of the switch because it is unnecessary to provide differing components.

The simplest manner of displacing the points of articulation 11, 12 at the switch rocker arm 5, that is, to vary the perpendicular distances $a_1$, $a_2$ with respect to imaginary extensions of the switch reeds 1, 2 through the pivot axes 9, 10 can be accomplished by a simple deformation of the switch rocker 5 in a zone of the points of articulation 11, 12. To provide independent deforming, the switch rocker 5 is subdivided in a zone of the points of articulation 11, 12 by a slot 33 (FIG. 1) into two flap-like shaped members with each of the flap-like shaped members receiving a point of articulation and thus being able to be bent independently of the other with respect to the remaining part of the switch rocker 5. However, it is also possible to provide for the stops 26 and 27 to be adjustable by, for example, externally adjustable set screws.

If the switch rocker 5 is turned by the operating piston 32 of the expansion element in such a manner that the direction of effectiveness of the switch springs 3, 4 approaches a longitudinal direction of the switch reeds 1, 2, then the force components acting in a transverse direction are increasingly reduced. In the above-noted zero position, wherein the direction of the effectiveness of the switch springs 3, 4 extends through the longitudinal direction of the switch reeds 1, 2, there is no force available by means of which the contacts 21 can be urged against the contacts 28. This can lead to difficulties under practical operating conditions since then there is a danger of chattering, especially also if the thermal switch is exposed to external mechanical vibrations. This can also lead to difficulties in a circuit connected to the thermal switch especially if the circuit has a relay. In order to avoid these contacting difficulties, as shown in FIGS. 7 and 8, the switch reeds 1, 2 are each equipped with resiliently mounted contacts 17 on a side facing the contacts 28. The contacts 17 are held by, for example, a leaf spring, which leaf spring, in an area of the passing through the zero position, ensures that the contact 17 contacts the associated contact 28 with a predetermined force. The spring stiffness or spring characteristic of the leaf spring is relatively small in comparison to the spring stiffness or spring characteristic of the switch springs 3, 4. If the switch springs 3, 4 still exert sufficient force, the switch reeds 1, 2 will contact the rear of the contact 17 while overcoming the forces of the leaf springs 16.

As shown in FIG. 7, in a top view, the leaf spring 16 on the switch reed 1 has a substantially U-shaped configuration, with two legs of the leaf spring 16 being attached in a zone of the ends of the reed 1 fashioned as blades 6, by means of suitable fasteners, such as rivets 34. The legs of the leaf spring 16 are attached to a side of the switch reed 1 which faces away from the contact 17. In a region of a free end of the switch reed 1, lateral recesses 35 are provided and, in a zone or area of the recesses 35, the leaf spring 16 is bent, so that a cross web of the U-shaped leaf spring 16, carrying the contact 17, comes to lie on the other side of the switch reed; namely, at a small spacing therefrom. Upon a touching of the contacts 17 and contacts 28, the leaf spring 16 may yield in a zone of its legs so that then the switch reed 1 may contact the contact 17 from the rear.

While I have shown and described only one embodiment in accordance with the present invention, it is understood that the same is not limited thereto, but is susceptible of numerous changes and modifications as known to a person skilled in the art, and I therefore do not wish to be limited to the details shown and described herein but intend to cover all such changes and modifications as are encompassed by the scope of the appended claims.

I claim:

1. A snap-action thermal switch adapted to be operated by an expansion means the switch including a switch reed mounted so as to be pivotable about a pivot axis between at least two switching positions, a switch spring means for exerting force components in a longitudinal direction of a switch reed and in a pivoting direction of the switch reed, and an adjusting means adjustable by the expansion means, said switch spring means being arranged such that, after the expansion means attains a predetermined position, a force component of the switch spring means acting in a pivoting direction on the switch reed reverses direction with respect to the switch reed after the switch reed traverses a zero position, characterized in that at least one second switch reed is mounted so as to be pivotable about a second pivot axis between two switching positions, at least one second switch spring means exerts a first component on the second switch reed in a longitudinal direction and a force component in the pivoting direction of the second switch reed, the second spring means is arranged such that a force component of the second switch spring means acting in the pivoting direction of the second switch reed reverses direction with respect to the second switch reed in a second predetermined position of the expansion means, and in that the reed switches are supported at a mounting plate means so that the respective pivot axes are vertically offset.

2. A snap-action thermal switch adapted to be operated by an expansion means, the switch including a switch reed mounted so as to be pivotable about a pivot axis between at least two switching positions, a switch spring means for exerting force components in a longitudinal direction of the switch reed and in a pivoting direction of the switch reed, and an adjusting means adjustable by the expansion means, said switch spring means being arranged such that, after the expansion means attains a predetermined position, a force component of the switch spring means acting in a pivoting direction of the switch reed reverses direction with respect to the switch reed after the switch reed traverses a zero position, characterized in that at least one second switch reed is mounted so as to be pivotable about a second pivot axis between two switching positions, at least one second switch spring means exerts a force component on the second switch reed in a longitudinal direction and a force component in the pivoting direction of the second switch reed, the second spring means is arranged such that a force component of the second switch spring means acting in the pivoting direction of the second switch reed reverses direction with respect to the second switch reed in a second predetermined position of the expansion means, the thermal switch further includes a base plate means, a mounting plate extending through the base plate means and forming a contact lug at one end thereof, at least two contact supports are mounted to the base plate means and are respectively associated with the reed switches, and in that each of the contact supports extend through the base plate means and terminate in contact lugs.

3. A snap-action thermal switch adapted to be operated by an expansion means, the switch including a switch reed mounted so as to be pivotable about a pivot axis between at least two switching positions, a switch spring means for exerting force components in a longitudinal direction of the switch reed and in a pivoting direction of the switch reed, and an adjusting means adjustable by the expansion means, said switch spring means being arranged such that, after the expansion means attains a predetermined position, a force component of the switch spring means acting in a pivoting direction on the switch reed reverses direction with respect to the switch reed after the switch reed traverses a zero position, characterized in that at least one second switch reed is mounted so as to be pivotable about a second pivot axis between the at least two switching positions, at least one second switch spring means exerts a force component on the second switch reed in a longitudinal direction and a force component in a pivoting direction of the second switch reed, the second spring means is arranged such that a force component of the second switch spring means acting in the pivoting direction of the second switch reed reverses direction with respect to the second switch reed in a second predetermined position of the expansion means, a mounting plate means is provided for supporting the reed switches such that the reed switches project approximately parallel to one another, the adjustment means includes a single switch rocker, mounted to the mounting plate means so as to be pivotable about the axis parallel to the pivot axis of the reed switches, each of the switch spring means is articulated to a first end of the switch rocker, with a second end of the switch rocker being operatively associated with the expansion means, and in that, in an initial position of the thermal switch, a perpendicular spacing of points of articulation of the respective spring means at the switch rocker, with respect to an imaginary extension of the associated switch reeds extended beyond the pivot axis thereof, are different from one another so that switching of the thermal switch is effected at different temperatures.

4. A thermal switch according to one of claim 3, characterized in that the reed switches are supported at the mounting plate means so that the respective pivot axes are vertically offset.

5. A thermal switch according to claim 4, characterized in that the switch rocker is a two-armed lever, one arm of the switch rocker includes two plastically deformable flap portions, and in that the switch spring means are articulated to the respective flap portions.

6. A thermal switch according to claim 5, characterized in that the thermal switch further includes a base plate means, the mounting plate extends through the base plate means and forms a contact lug at one end thereof, at least two contact supports are mounted to the base plate means and are respectively associated with the reed switches, and in that each of the contact supports extend through the base plate means and terminate in contact lugs.

7. A thermal switch according to claim 6, characterized in that the contact supports are arranged along a common radius with respect to a center of the base plate means and are offset in a circumferential direction by a predetermined angle.

8. A thermal switch according to claim 7, characterized in that the predetermined angle is approximately 90°.

9. A thermal switch according to claim 7, characterized in that each of the switch spring means and each of the switch reeds are identically constructed.

10. A thermal switch according to claim 9, characterized in that contact means are provided, and in that means are provided for holding the contact means on each switch reed on a side thereof facing the contact supports.

11. A thermal switch according to claim 10, characterized in that the holding means is a spring.

12. A thermal switch according to claim 11, characterized in that the spring is a leaf spring attached to the switch reeds in proximity to the pivot axis of the switch rocker on a side facing away from contacts of the contact supports, the contact means are arranged at a free end of the leaf spring, the free end of the leaf spring is extended at a spacing over a side facing contacts of the contact supports.

13. A thermal switch according to claim 12, characterized in that the leaf spring has a small spring stiffness which is less than a spring stiffness of the switch spring means.

14. A thermal switch according to claim 13, characterized in that at least one of the mounting plate means and the base plate means are provided with means for centering the switch spring means during assembly of the switch.

15. A thermal switch according to claim 14, characterized in that the centering means are notch-like guides.

16. A thermal switch according to claim 14, characterized in that a spacing is provided between the mounting plate means and the contact supports in a longitudinal direction of the switching reeds, and in that the spacing corresponds to at least a length of the switch reeds.

17. A thermal switch according to claim 14, characterized in that the expansion means includes an operating piston means engageable with one of the arms of the switch rocker for moving the switch rocker, and in that each of the switch reeds includes a blade portion.

18. A thermal switch according to claim 3, characterized in that the switch rocker is a two-armed lever, one arm of the switch rocker includes two plastically deformable flap portions, and in that the switch spring means are articulated to the respective flap portions.

19. A thermal switch according to one of claim 3, characterized in that the thermal switch further includes a base plate means, the mounting plate extends through the base plate means and forms a contact lug at one end thereof, at least two contact supports are mounted to the base plate means and are respectively associated with the reed switches, and in that each of the contact supports extend through the base plate means and terminate in contact lugs.

20. A thermal switch according to claim 19, characterized in that contact means are provided, and in that means are provided for holding the contact means on each switch reed on a side thereof facing the contact supports.

21. A thermal switch according to claim 20, characterized in that the holding means is a leaf spring.

22. A thermal switch according to claim 19, characterized in that at least one of the mounting plate means and the base plate means are provided with means for centering the switch spring means during assembly of the switch.

23. A thermal switch according to claim 3, characterized in that the centering means are notch-like guides.

24. A thermal switch according to claim 3, characterized in that the expansion means includes an operating piston means engageable with one of the arms of the switch rocker for moving the switch rocker, and in that each of the switch reeds includes a blade portion.

25. A thermal switch according to claim 3, characterized in that the second spring means is articulated to the adjusting means.

* * * * *